US008398846B2

(12) United States Patent
Overwater et al.

(10) Patent No.: US 8,398,846 B2
(45) Date of Patent: Mar. 19, 2013

(54) PROCESS FOR CRACKING A HYDROCARBON FEEDSTOCK COMPRISING A HEAVY TAIL

(75) Inventors: Jacobus Arie Schilleman Overwater, Gouda (NL); Johannes Pieter Van Der Eijk, Den Haag (NL)

(73) Assignee: Technip France (FR)

( * ) Notice: Subject to any disclaimer, the term of this patent is extended or adjusted under 35 U.S.C. 154(b) by 308 days.

(21) Appl. No.: 11/814,447

(22) PCT Filed: Jan. 20, 2006

(86) PCT No.: PCT/NL2006/000030

§ 371 (c)(1),
(2), (4) Date: Oct. 16, 2007

(87) PCT Pub. No.: WO2006/078159

PCT Pub. Date: Jul. 27, 2006

(65) Prior Publication Data

US 2008/0135451 A1 Jun. 12, 2008

(30) Foreign Application Priority Data

Jan. 20, 2005 (EP) ..... 05075152

(51) Int. Cl.
*C10G 9/14* (2006.01)
*C10G 9/20* (2006.01)

(52) U.S. Cl. ..... 208/132; 208/125; 208/128; 208/130; 422/198; 422/200; 422/201

(58) Field of Classification Search ..... 208/106, 208/125, 128, 130, 132; 422/198, 200, 201
See application file for complete search history.

(56) References Cited

U.S. PATENT DOCUMENTS

| | | | | |
|---|---|---|---|---|
| 4,361,478 | A * | 11/1982 | Gengler et al. | 208/130 |
| 4,879,020 | A | 11/1989 | Tsai | 208/130 |
| 4,908,121 | A * | 3/1990 | Hackemesser et al. | 208/85 |
| 5,445,799 | A * | 8/1995 | McCants | 422/146 |
| 5,580,443 | A | 12/1996 | Yoshida et al. | 208/130 |
| 2005/0261536 | A1 * | 11/2005 | Stell et al. | 585/648 |

FOREIGN PATENT DOCUMENTS

| | | |
|---|---|---|
| EP | 0 253 633 | 1/1988 |
| GB | 577682 | 5/1946 |

* cited by examiner

*Primary Examiner* — Walter D Griffin
*Assistant Examiner* — Renee E Robinson
(74) *Attorney, Agent, or Firm* — Ostrolenk Faber LLP

(57) ABSTRACT

The invention relates to a process for thermally cracking a hydrocarbon feed in an installation comprising a radiant section and a convection section, wherein a hydrocarbon feed stock is fed to a feed preheater present in the convection section, the heat pick-up of the feed preheater is controlled by regulating the heat exchange capacity of an economiser, said economiser being located in the convection section between the feed preheater and the radiant section, and wherein the feed heated in the preheater is thereafter cracked in the radiant section. The invention further relates to an installation for the cracking of a hydrocarbon feed.

21 Claims, 4 Drawing Sheets

PROCESS FOR CRACKING A HYDROCARBON FEEDSTOCK COMPRISING A HEAVY TAIL

CROSS REFERENCE TO RELATED APPLICATION

The present application is a 35 U.S.C. §§371 national phase conversion of PCT/NL2006/000030, filed Jan. 20, 2006, which claims priority of European Application No. 05075152.8, filed Jan. 20, 2005. The PCT International Application was published in the English language.

FIELD OF THE INVENTION

The invention relates to a process for cracking a feedstock, in particular a low-quality feedstock with a heavy tail, i.e. a feedstock with a relatively high fraction of one or more components which are vaporised at a higher temperature than average feedstock (if vaporisable at all). Examples of such components are tar, solid particles, heavy hydrocarbon fractions such as high-boiling fractions and evaporation residuum fractions.

When feedstock with a heavy tail is cracked in a thermal cracking furnace (pyrolysis furnace), the heavy tail usually causes fouling in the convection section, radiant section and transferline exchangers. This fouling results in short on-stream time and thus in uneconomical operation.

BACKGROUND OF THE INVENTION

U.S. Pat. No. 5,580,443 suggests a pyrolysis process wherein fouling/coking is reduced. In this publication, a process is described for pyrolysis of a low quality feedstock into olefins by a process wherein the feed is preheated and partially vaporized in a feed preheater. The remaining liquid feed is separated at the outlet of the feed preheater in a separating device after mixing with an amount of superheated dilution steam. The amount of liquid feed to be separated is controlled by the amount and/or ratio of superheated dilution steam that is mixed upstream and downstream of the separating device. The process may make use of an economiser, without any means for controlling the capacity (heat pick-up) of the economiser.

U.S. Pat. No. 4,879,020 relates to a method of operating a furnace hydrocarbon converter. A process for thermally cracking a feed wherein the heat pick-up of a feed preheater is controlled by regulating the exchange capacity of an economiser is not disclosed in this publication either.

In U.S. Pat. No. 6,632,351, a pyrolysis process is described, wherein the feed to be separated is heated to a temperature of at least 375° C. prior to separating the feed in a liquid and a vaporous fraction.

EP-A 253 633 describes a hydrocarbon cracking furnace containing heat exchangers. Each has its own feedstock supply such that flow and pressure drop can be controlled independently. It is not suggested to control the heat pick-up of the feed preheater, and thereby the vaporisation temperature of the feedstock.

Prior art processes such as mentioned above have a limited flexibility for variations in process conditions, such as variations in feedstock characteristics, cracking severity, steam dilution ratio and furnace turndown. This is due to the fact that the separation control by mixing an amount of superheated dilution steam is only adequate for conditions that are close to a single design case. For larger deviations from the design case the amount of liquid that is separated may be too much (improper process efficiency) or too little (improper separation, causing fouling in downstream equipment).

Still, it is desired to provide alternative processes for cracking feedstock, in particular feedstock comprising a heavy tail.

SUMMARY OF THE INVENTION

Accordingly, it is an object of the invention to provide a novel process for cracking a hydrocarbon feed with a low tendency to cause fouling (coking) of the cracking installation in which the process is carried out.

In particular it is an object to provide a novel process of cracking a hydrocarbon feed, such as a hydrocarbon feed with a heavy tail, which process shows good flexibility with respect to variations in process conditions, such as variations in feedstock characteristics and desired cracking severity.

It is further an object of the invention to provide a novel installation for cracking a hydrocarbon feedstock, suitable for carrying out a process according to the invention.

It has been found that it is possible to crack a hydrocarbon feedstock, in particular such a feedstock with a heavy tail, by controlling a process parameter at or near the exit for the flue gas in the convection section of the cracking installation, namely by preheating the feedstock in the convection section of a cracking installation prior to cracking the feedstock in the radiant section of the cracking installation and controlling the heat pick-up of the feed preheater (located near the exit for the flue gas out of the convection section). Thus, it is possible to maintain the temperature of the flue gas exiting the convection section at a desirably low temperature. Hereby a high level of heat recovery from the flue gas can be realised. In addition, controlling the heat pick-up of the feed preheater allows control of the feedstock vaporisation temperature.

Accordingly, in an aspect, the invention relates to a process for thermally cracking a hydrocarbon feed in a cracking installation comprising a radiant section 6 and a convection section 7, wherein a hydrocarbon feedstock is fed to a feed preheater 1 present in the convection section 7, the heat pick-up of the feed preheater 1 is controlled by regulating the heat exchange capacity of an economiser 9 located in the convection section 7 between the feed preheater 1 and the radiant section 6; and wherein thereafter the feed heated in the preheater 1 is led to the radiant section 6 and cracked in said radiant section 6.

By regulating the heat capacity of the economiser 9, the heat pick up of the feed preheater 1 can be controlled, such as by regulating the flow of heat exchange medium through the economiser. The controlling of the heat pick up in turn allows the regulation of the ratio of liquid fraction to vapour fraction of the feed at the outlet of the feed preheater.

Preferably, in addition to the economiser 9, another economiser 8 is employed, situated between the preheater 1 and the outlet for the flue gas of the convection section 7.

This economiser 9 is usually operated in parallel fluid communication with economiser 8 (see e.g. FIG. 1). Through this economiser additional heat exchange medium (usually water, also referred to as boiler feed water) is routed. This set-up helps to ensure that the stack temperature (the temperature of the flue gas at the outlet of the convection section) is maintained at a desirable temperature, in particular about 5-20° C. above the temperature of the heat exchange medium at the inlet of economiser 8.

In a suitable embodiment, the economiser 8 is omitted. In particular in such an embodiment, the economiser 9 is provided with a bypass—usually in parallel fluid communication—for instance as indicated in FIG. 2. Installation of a bypass x' around economiser 9 and omitting economiser 8 usually results in a higher stack temperature when the process requires a low heat pickup in economiser 9 and in the feed preheater.

In a further aspect, the invention relates to a process for thermally cracking a hydrocarbon feedstock in an installation comprising a radiant section and a convection section, wherein the flue gas temperature at the exit is at a temperature of about 150° C. or less, in particular to a temperature in the range of about 90° C. to about 130° C., more in particular to a temperature in the range of 95-130° C. It is noted that in accordance with the invention it is possible to keep the stack temperature within a desired range while simultaneously having a high degree of flexibility for variations in process conditions, such as variation in feedstock characteristics, cracking severity, dilution gas (steam) ratio and furnace turndown.

Furthermore, the invention relates to a process for thermally cracking a hydrocarbon feedstock in an installation comprising a radiant section and a convection section, wherein a hydrocarbon feed stock is fed to a feed preheater present in the convection section (near the flue gas exit), the heat pick-up of the feed preheater is controlled by regulating the heat exchange capacity of an economiser, the economiser being located in the convection section between the feed preheater and the radiant section, said economiser being provided with a bypass for heat exchange medium (in particular boiler feed water). The heat pick-up of the economiser can be controlled by regulating the heat exchange medium flow through the economizer. The remainder of the heat exchange medium which may be used for the process will be bypassed and mixed with the heat exchange medium through the economiser at the outlet of the economiser or in a steam drum and wherein the feed heated in the preheater is thereafter cracked in the radiant section. Using a first and a second economiser or an economiser and a bypass, makes it possible to control the heat pick-up of the feed preheater while keeping the stack temperature within a desired range.

The invention further relates to an installation for cracking a hydrocarbon feedstock comprising a radiant section and a convection section, comprising a feed preheater, present in the convection section, for heating a hydrocarbon feedstock that is to be cracked, an economiser, located in the convection section between the feed preheater and the radiant section, of which economiser the heat exchange capacity is controllable by a controller.

and a conduit for feeding the heated feed to the radiant section for cracking the heated feed.

The invention in particular further relates to an installation for cracking a hydrocarbon feedstock comprising a radiant section 6 and a convection section 7, wherein in the convection section a feed preheater 1 is present for heating a hydrocarbon feedstock that is to be cracked, the feed preheater being located between a first economiser 8 and a second economiser 9, the first economiser 8 being located in the convection section between the flue gas exit and the feed preheater 1, the second economiser 9 being located in the convection section 7 between the feed preheater 1 and the radiant section 6;

and a conduit g for feeding the heated feed to the radiant section for cracking the heated feed.

The first and second economiser in the installation are usually lined-up such that their fluid conduits are in parallel fluid communication. Further the installation usually comprises a controller for regulating the heat pick-up in the economisers, in particular a controller for regulating the flow of heat exchange medium through the economiser.

DESCRIPTION OF PREFERRED EMBODIMENTS OF THE INVENTION

Figure 1:
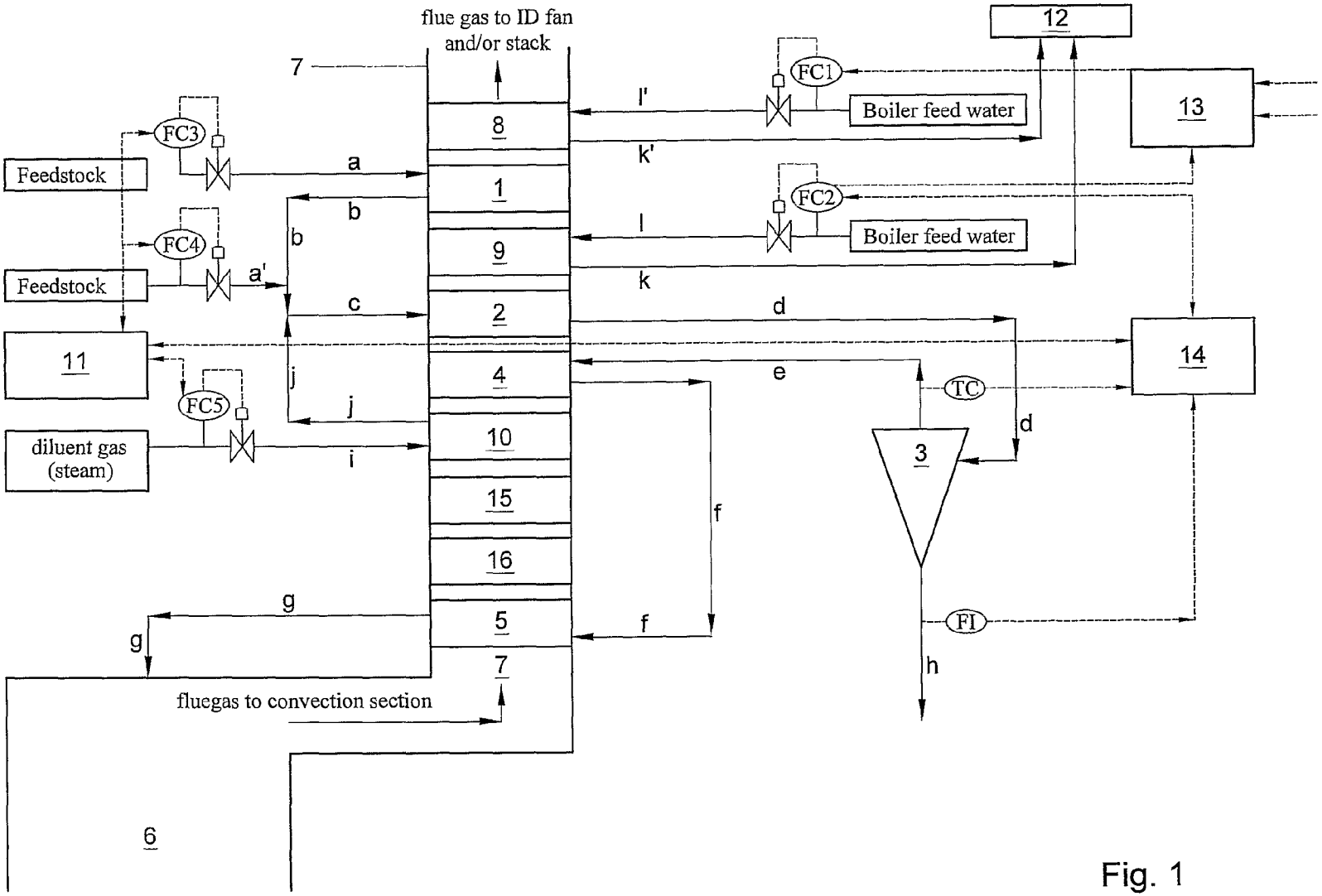
FIG. 1 schematically shows an embodiment of an installation for carrying out a process according to the invention, comprising (the use of) at least two parallel economisers.

The invention provides a process, respectively an installation, which has a low tendency of cokes formation.

The invention is very suitable to provide a product gas comprising one or more olefins, in particular a product gas comprising at least one olefin selected from the group consisting of ethylene, propylene and butylenes.

The invention provides a process, respectively an installation, which shows good flexibility with respect to variations in feedstock compositions.

Compared to a conventional installation respectively process, such as described in U.S. Pat. No. 5,580,443, the invention provides the possibility to operate more effectively because in accordance with the invention the heat pick-up of the process stream in the preheater (upstream the separation device, if present) can be controlled in a wide range. The heat pick up of the feed preheater is adjustable in accordance with the invention. In said prior art the heat pick up is fixed and the duty of the variable flow of superheat dilution steam used in said prior art is too small for an adequate and flexible control.

In an advantageous embodiment, the invention allows the separation of a heavy fraction prior to the thermal cracking process in a specially controlled manner, whereby an adequate degree of separation is accomplished for various cracking process conditions (variations in feedstock characteristics, cracking severity, steam dilution ratio and furnace turndown) while simultaneously a high furnace thermal efficiency is maintained by heat recovery in the convection section for all said various cracking conditions.

Unless specified otherwise, when reference is made to the location of a piece of equipment (such as a preheater, economiser, superheater etc.) provided in the convection section, the equipment may be referred to as relatively close to the top if it is relatively close to the outlet for the flue gas and relatively close to the bottom if it is relatively close to the radiant section. Usually, a module referred to as "being on top" will be at a vertically higher position than a module referred to as being "at the bottom". However, it is not excluded that a "top" module and a "bottom" module are at the same horizontal plane.

For example, an economiser present between the preheater and the radiant section may be referred to as the bottom economiser (for being relatively close to the radiant section, compared to the preheater) and an economiser present between the preheater and the exit for the flue gas out of the convection section may be referred to as a top economiser (for being relatively close to the exit for the flue gas, compared to the preheater).

Within the context of the present application, when a piece of equipment is specified to be between two other parts of an installation (used) according to the invention, it is between said other parts viewed from the flow direction of the flue gas through the installation. Thus, the part needs not be in the (vertical, horizontal or diagonal) plane generally defined by the two other parts. For example, a diluent gas preheater 10 located between the radiant section 6 and the feed preheater 1 need not be vertically above the radiant section 6 and vertically below the preheater 1.

Unless specified otherwise, the terms upstream and downstream are used for the position of a module relative to the hydrocarbon feed stream. Thus, the entrance into feed preheater 1 is upstream from the (cracking coil(s) in the) radiant section 6.

The term "about" and the like, as used herein, is in particular defined as including a deviation of up to 10%, more in particular up to 5%.

The heat pick-up of the feed preheater is defined herein as the heat which is taken up by the feedstock routed through the feed preheater. This term may also be referred to as duty.

The terms "high boiling fraction" and "low boiling fraction" are in particular used herein to describe the fraction that is removed from the feed prior to cracking (i.e. usually the fraction that remains in the liquid phase in the separator) respectively the fraction that is fed to the radiant section (i.e. usually the fraction that is vaporised in the separator). It should be noted that the "boiling temperature" when referred to in the terms "high boiling fraction" and "low boiling fraction" generally relate to a standardized test method such as ASTM D2887 and not necessarily to the actual temperatures under the process conditions at which the separation takes place, as the boiling temperature is influenced by the operating pressure and the ratio of diluent gas to the feed.

As a hydrocarbon feed, in principle any feed comprising one or more hydrocarbons, suitable to be cracked thermally, may be used. In particular, the feed may comprise a component selected from the group consisting of ethane, propane, butanes, naphthas, kerosenes, atmospheric gasoils, vacuum gasoils, heavy distillates, hydrogenated gasoils, gas condensates and mixtures thereof. Suitable feedstock include feedstock as mentioned in U.S. Pat. No. 5,580,443 and U.S. Pat. No. 6,632,351. Very suitable is a feedstock having at least one of the following vaporisation characteristics: up to 70 wt % vaporises at 170° C., up to 80% vaporises at 200° C., up to 9 wt % vaporises at 250° C., up to 95 wt % vaporises at 350° C., up to 99.9 wt % vaporises at 700° C., as determined by ASTM D-2887.

In particular, the process of the invention is advantageously used for cracking a hydrocarbon feed with a heavy tail, i.e. having a relatively high content of high boiling hydrocarbons, e.g. tar; solid particles and/or other components that are likely to cause coking, unless precautions are taken.

The heavy tail is in particular a fraction of the feedstock that remains in the liquid fraction when the feedstock is heated to a temperature of 300° C., more in particular when the feedstock is heated to a temperature of 400° C., even more in particular to a temperature of 500° C. (as determined by ASTM D-2887).

The process of the invention is in particular advantageous for processing a feedstock wherein the fraction of the heavy tail in the feedstock is about 10 wt. % or less, preferably about 1 wt. % or less, more preferably about 0.2 wt. % or less. The heavy tail fraction may be about 0.01 wt. % or more, in particular about 0.1 wt. % or more, more in particular about 0.5 wt. % or more.

Examples of a hydrocarbon feed with a heavy tail include natural gas condensates, such as heavy natural gas liquid (HNGL), kerosene, atmospheric gas oils, vacuum oils, heavy distillates.

The design of the radiant section is not particularly critical and may be a radiant section as known in the art. Also, the basic design of the convection section may be as described in the art (with the addition of equipment as described herein, such as the economiser(s), at the specified locations). Examples of radiant sections respectively convection sections include those described in the prior art cited herein, the GK6™ cracking furnace (Technip) and a furnace as described in European application 04075364.2.

Also the parts as such, used in the cracking installation (such as feed preheater(s), economiser(s), separator(s), controllers, etc.) may generally be based upon designs known in the art.

The temperature to which the heat is heated in the preheater may be chosen within wide limits, depending upon the exact nature of the feedstock and the desired properties of the product produced in the radiant section.

Although it is in principle possible to heat the feed to a higher temperature in the preheater, it is usually sufficient to heat the feed in the preheater to a temperature of less than 200° C. Preferably, the temperature of the feed leaving the preheater is about 170° C. or less, more preferably about 140° C. or less. Preferably the temperature of the feed leaving the preheater is at least about 90° C., more preferably at least about 110° C. This allows, the flue gas exit temperature to be relatively low and results in substantially avoiding fouling/coke formation in the feed conduits in the upper part of the convection section. As indicated above, in accordance with the invention, the heat pick-up of the feed preheater may be controlled.

The heat exchange capacity may be controlled by a bottom economiser (item 9 in Figures). In general, if desired, the heat pick-up of the feed preheater is increased if the liquid fraction at the outlet of a (diluent gas-hydrocarbon mixture) preheater 2 respectively at the inlet of separator 3 is to be reduced, by reducing the flow of the heat exchange medium through the bottom economiser and thus decreasing the heat pick-up of the bottom economiser. The heat exchange capacity and the flue gas exit temperature depend on the heat pick-up of the top economiser which may float and depend on the heat pick of the feed preheater and the bottom economiser. In general, if desired, the capacity of the feed preheater is increased if the liquid fraction at the outlet of (diluent gas hydrocarbon mixture) preheater 2 is to be reduced by increasing the heat pick-up of the bottom economiser 9. The flue gas exit temperature may be kept low by installing (operating) an economiser 8 above the feed preheater 1.

In a preferred embodiment, the heat pick-up of the feed preheater 1 and/or the flue gas exit temperature is controlled by regulating the flows of the heat exchange mediums (usually boiler feed water) flowing through a first (top) and a second (bottom) economiser, between which the preheater is positioned. In particular the ratio of the flow through the first to the flow through the second economiser may be controlled. Usually the ratio (flow to top/flow to bottom) is decreased in case the liquid fraction at the outlet (of steam/hydrocarbon) preheater 2 respectively at the inlet of separator 3 is to be increased The heat pick-up of the feed preheater can be further reduced if desired by controlling a bypass around the feed preheater. This may be accomplished by mixing a controlled amount of additional (feed preheater bypassed unheated) feedstock to the heated feed. In general, if desired, the capacity of the feed preheater is increased routing full flow through the feed preheater and decreasing heat exchange medium through the bottom economiser.

The feed preheater heat pick-up (heat exchange capacity) may be controlled in order to regulate the composition of the feedstock routed to the radiant section. In general, if desired, the capacity of the feed preheater is increased if the objective is to decrease the ratio low boiling to high boiling fraction. The feed preheater heat pick-up can be increased by decreasing the heat exchange medium flow through the bottom economiser (which decreases heat pick up of bottom economiser).

In a preferred embodiment, the process comprises separating the feed heated in the preheater into a low boiling (vaporous) fraction and a high boiling (liquid) fraction, which low boiling fraction is thereafter cracked in the radiant section. The liquid fraction may be disposed of without being cracked. It is possible to further use the liquid fraction or part thereof in the process. In particular (part of the) liquid fraction may be mixed with fresh feedstock prior to entering the feed preheater 1 and/or (part of the) liquid fraction may be used downstream of the radiant section, in particular be mixed with cracked gas.

In an installation (used in a process) according to the invention, the separator is generally positioned downstream of the feed preheater and upstream of the radiant section, outside both sections. As a separator, in principle any separator suitable for separating hydrocarbons heaving different boiling temperatures may be used. Examples of suitable separators are cyclones. Examples of suitable separators are e.g. described in U.S. Pat. No. 6,376,732, U.S. Pat. No. 5,580,443 and U.S. Pat. No. 6,632,351.

Before entering the separator, the feed (usually mixed with a diluent gas, as further described below) is usually further heated in a second preheater to a temperature at which the fraction of the feed that is to be cracked is vaporised and the fraction that is to be removed from the feed (the high boiling fraction) remains liquid.

The desired temperature at which the feed enters the separator depends on feedstock characteristics and/or process conditions, and desired product gas. Although it is in principle possible to heat the feed to a temperature exceeding 375° C., it is generally sufficient to heat the feed to a temperature of less than 375° C., in particular to about 300° C. or less, preferably to about 260° C. or less. The desired temperature level depends on the feedstock characteristic. In order obtain an advantageous amount of vaporised fraction the feed is usually heated to a temperature of at least about 190° C., preferably to a temperature of at least about 205° C., more preferably to a temperature of about 210° C. or more.

The ratio liquid fraction to vapour fraction separated from each other may be chosen within wide limits, depending upon the intended product quality. Usually the weight to weight ratio is at least about 0.01, preferably about 0.02 or more. In practice the ratio is usually about 0.7 or less, preferably about 0.35 or less, more preferably about 0.1 or less, even more preferably less than 0.04.

The installation (used in the process) according to the invention is preferably provided with a feed preheater heat pick-up controller, comprising an input for registering the temperature of the vapour leaving the separator and/or an input for registering the liquid flow of the fraction leaving the separator, and an output for regulating the flow and/or temperature of the heat exchange media of the economisers. Preferably, the controller comprises a calculator.

The hydrocarbon feed, heated in the preheater is usually mixed with a diluent gas prior to cracking, and if a separator is used, preferably before separating the feed in a liquid fraction and a vapour fraction. Examples of diluent gas are vaporised naphtha, refinery off gasses, nitrogen, methane, ethane, steam and mixtures thereof, wherein a diluent gas comprising steam is preferred.

The (weight to weight) ratio diluent gas (steam) to hydrocarbon feed may be chosen within wide limits, usually within the range of 0.3 to 1.0, preferably 0.4 to 0.8.

In general, the invention may be carried out without needing to adjust the ratio diluent gas to hydrocarbon feed during the process (in order to avoid cokes formation). The ratio diluent gas to hydrocarbon feed may be kept essentially constant in particular if the hydrocarbon feedstock quality is essentially constant, whilst maintaining a low tendency to coke formation. In general, a process according to the invention may be carried out without mixing additional diluent gas to the vaporous hydrocarbon fraction, after leaving the separator.

FIG. 1 shows a preferred embodiment of the invention, representing a preferred installation and a process flow diagram for a preferred process. Thin (dotted) arrows represent the transfer of data. Thick (straight) arrows represent a flow of a substance (such as feed, diluent gas, heat exchange medium) It should be noted that not all equipment (such as heaters, separators, controllers and other equipment shown) are essential in every aspect of the invention. They may just be preferred.

Feed Flow

The feedstock (usually a feedstock with heavy tail) is routed via conduit a to the feed preheater 1 in which the feed is preheated (usually to between 90 and 170° C., in particular to about 130° C.) and optionally partially vaporised.

The preheated feed leaving the outlet of the feed preheater 1 via conduit b is then preferably mixed with diluent gas (steam) (from conduit j). The diluent gas is preferably heated in the convection section prior to being mixed with the feed in a diluent gas preheater 10, into which the diluent is led via conduit i. The diluent gas preheater 10 (if present) is usually located relatively low in the convection section 7, where the temperature of the flue gas is still relatively high, in particular between the radiant section 6 and the preheater 1 (and preferably between radiant section and feed preheaters 4 and/or 2, if present).

Heated diluent gas (steam) may in particular be used in order to flash vaporize the feed from the feed preheater 1, outside the convection section especially in case the feedstock is naphtha.

A conduit a' for feeding additional feedstock to the preheated feed in conduit b or to the preheated feed mixed with diluent gas in conduit c may be present.

The preheated feed (preferably mixed with diluent gas) is then usually led to a second preheater 2 (which may be referred to as a diluent gas/hydrocarbon preheater) to bring the feed to a temperature at which the fraction to be cracked is vaporised and the heavy tail is still present in the liquid fraction, such that it can be removed from the vaporised fraction.

The temperature of the feed leaving the preheater 2 via conduit d may advantageously have a temperature between 190° C. to 260° C., in particular a temperature of about 210° C.

The feed is then led via conduit d to the separator 3 for separating the feed in a high boiling fraction and a low boiling fraction.

The vaporised fraction (low boiling fraction) will reduce if the heavy fraction to be separated increases. The liquid/gas separator 3 (such as a cyclone or knock out vessel) separates high boiling (liquid) hydrocarbons and other high boiling components from the low boiling fraction (vaporous) stream. In particular in case a cyclone or knock out vessel is used, the vapour/liquid separation is equivalent to a single theoretical stage.

Therefore, it is preferred, in particular such an embodiment that a quantity of relatively low boiling hydrocarbons in excess of the actual amount of "heavy tail" is present in the liquid phase for a highly effective separation. In particular, it is considered advantageous when the liquid fraction of the feed that is separated from the vaporous fraction in the separator comprises the heavy tail plus at least about an equal amount of hydrocarbons not specified as heavy tail (such as low boiling hydrocarbons). Highly suitable is a process wherein the weight of the liquid fraction leaving the separator is about 2 to about 20 times the weight of the actual heavy tail.

The high boiling fraction is removed from the separator 3 via conduit h (typically as a liquid) and may be disposed of. The low boiling fraction is the fraction to be cracked and is led towards the radiant section 6 via conduits e, f and g.

Before being fed to the radiant section 6 (typically into a cracking coil, not shown) via conduit g, the low boiling fraction is preferably further heated in one or more additional feed preheaters (such as 4 and 5, connected via conduit f, as shown in FIG. 1). Such preheater or preheaters are usually positioned in a lower part of the convection section, where the flue gas has a higher temperature than in a higher part.

A feed preheater 4 may in particular be located between preheater 1 (respectively 2, if present) and the radiant section. Preheater 4 is preferably located between preheater 1 (respectively 2, if present) and the diluent gas preheater 10, if present.

A feed preheater 5 may be located closest to the radiant section of all preheaters, in particular of all feed preheaters. Thus, it is preferably present between the radiant section 6 and the feed preheater 1 (in particular 2, more in particular 4, if present). In case the diluent gas preheater 10 is provided in the convection section, the preheater 5 is preferably located between diluent gas preheater 10 and the radiant section.

The feed is preferably heated to a temperature of about 550° C. to about 650° C. in the last preheater (in particular 5) and then fed into the radiant section via conduit g.

Optionally, the cracking furnace comprises one or more high pressure steam superheaters. In FIG. 1, two of these are provided (15, 16). If present, the superheater(s) is (are) preferably present relatively low in the convection section, in particular closer to the radiant section than diluent gas preheater 10 and feed preheaters 1, 2 and 4 (in as far as they are present).

If present, the high pressure steam superheaters may be used to superheat the saturated steam produced in the cracking furnace. Saturated steam is generated by the transferline exchangers located downstream the radiant section Controlling/Regulating In particular if a separator is used, an important aspect to define the weight ratio of the fractions to be separated from each other (and thus the size of the fraction to be cracked), is the temperature at the outlet of preheater 2 (determining the amount of liquid fraction, fed to the separator). This temperature may advantageously be controlled by controlling the heat pick-up of the feed preheater 1 with a "sandwiched" feed preheater design. The "sandwiched" feed preheater design encompasses a feed preheater 1 situated between at least two economiser convection section banks (economisers 8 and 9).

In accordance with the invention, it is possible to control the removal of the heavy tail adequately by regulating the heat pick-up of the feed preheater, in particular by regulating the flow of heat exchange medium (usually boiler feed water) over the economiser 9 and, As a result, the fluegas temperature at the inlet of the (preferably "sandwiched") feed preheater 1 can be adjusted, thereby creating a degree of freedom for heat pick-up control of this feed preheater 1, such that the desired amount of heavy tail liquids may be separated downstream, usually after further preheating and after mixing with diluent gas, such as superheated dilution steam (see above).

The top economiser 8 is preferably provided to ensure that the stack temperature and corresponding furnace efficiency can be kept at a level according modern industrial standard. Thus, a efficiency of about 94% or more is envisaged to be achievable.

Figure 2:
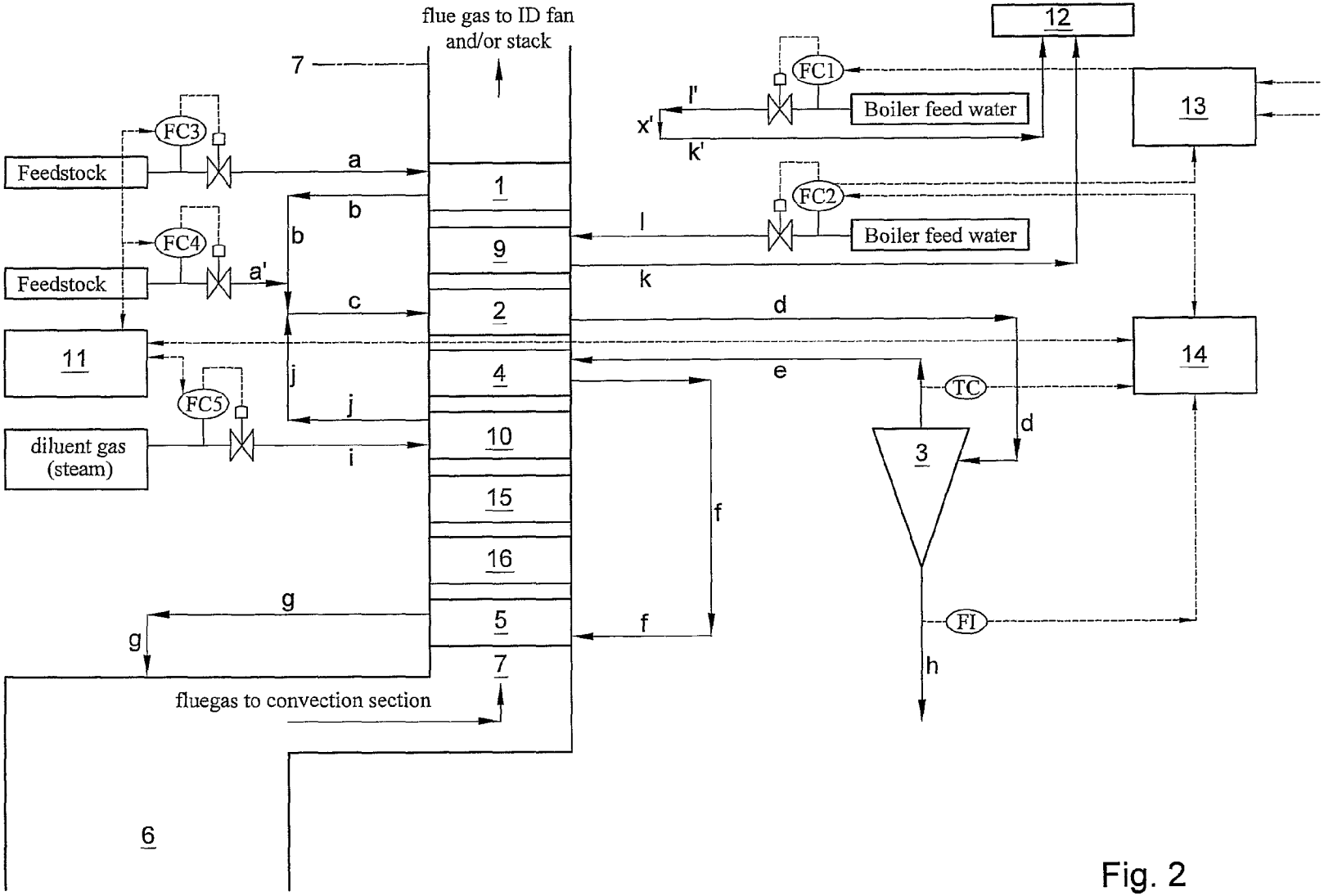
FIG. 2 schematically shows an embodiment for an installation for carrying out a process according to the invention, comprising the use of a bypass, in parallel connection with an economiser.

The top economiser 8 may be omitted, in particular if additional heat recovery is not important or significant. In this case a single economiser may be used, such as a bottom economiser 9 with bypass, in particular as indicated in FIG. 2. In such an embodiment, heat exchange medium will partially be routed through economiser 9, and partially be fed to steam drum 12 without being routed through an economiser. This usually results in a lower recovery of excess heat from the flue gas, but has as an advantage a somewhat simpler design with lower investment cost.

With respect to controlling the heat exchange capacity of the economiser 9, the capacity may be adjusted by regulating flow of the heat exchange medium that is led to economiser 9 (via conduits l) and led away from the economiser(s) (via conduits k), e.g. to a steam drum. The steam drum serves as an hold-up for heat exchange medium (boiler water) which may be use for transferline exchangers, which may be present to generate saturated steam, and that may be employed downstream of the radiant section. The flow through conduit l may advantageously be regulated with flow controller FC1 which controls a valve in the conduit l based upon input it receives from feed preheater heat pick-up calculator 14. Typical input parameters are the temperature of the vaporised hydrocarbon feed in conduit e (when leaving separator 3), flow volume of the liquid fraction in conduit h (removed from the hydrocarbon feed in the separator 3). Additional inputs that may be used include the furnace capacity and steam to oil ratio.

The capacity of economiser 8 may adequately be regulated with flow controller FC2 which controls a valve in the conduit l'. FC2 may regulate the flow based upon input it receives from the steam drum level controller 13, which typically uses the flow properties controlled by FC1, the steam drum 12 level and the export steam flow as inputs.

Another factor which may be used to control the process such that it has a low tendency to cause coking of the conduits (and thereby improving the duration the process can be continued without needing maintenance, requiring the stopping of the process), is the feed flow which bypasses the feed preheater.

This parameter may in particular be controlled via the furnace capacity controller 11, which may base its output on an input based on the total feed capacity to the furnace "a+a'" and the feed capacity through the bypass of the feed preheater "a'" set by the operator, the actual flow through conduit a, through conduit a', and through conduit i, as monitored via FC3, FC4, respectively FC5. The furnace capacity controller 11 may also be used to control feed and dilution steam.

Figure 3:
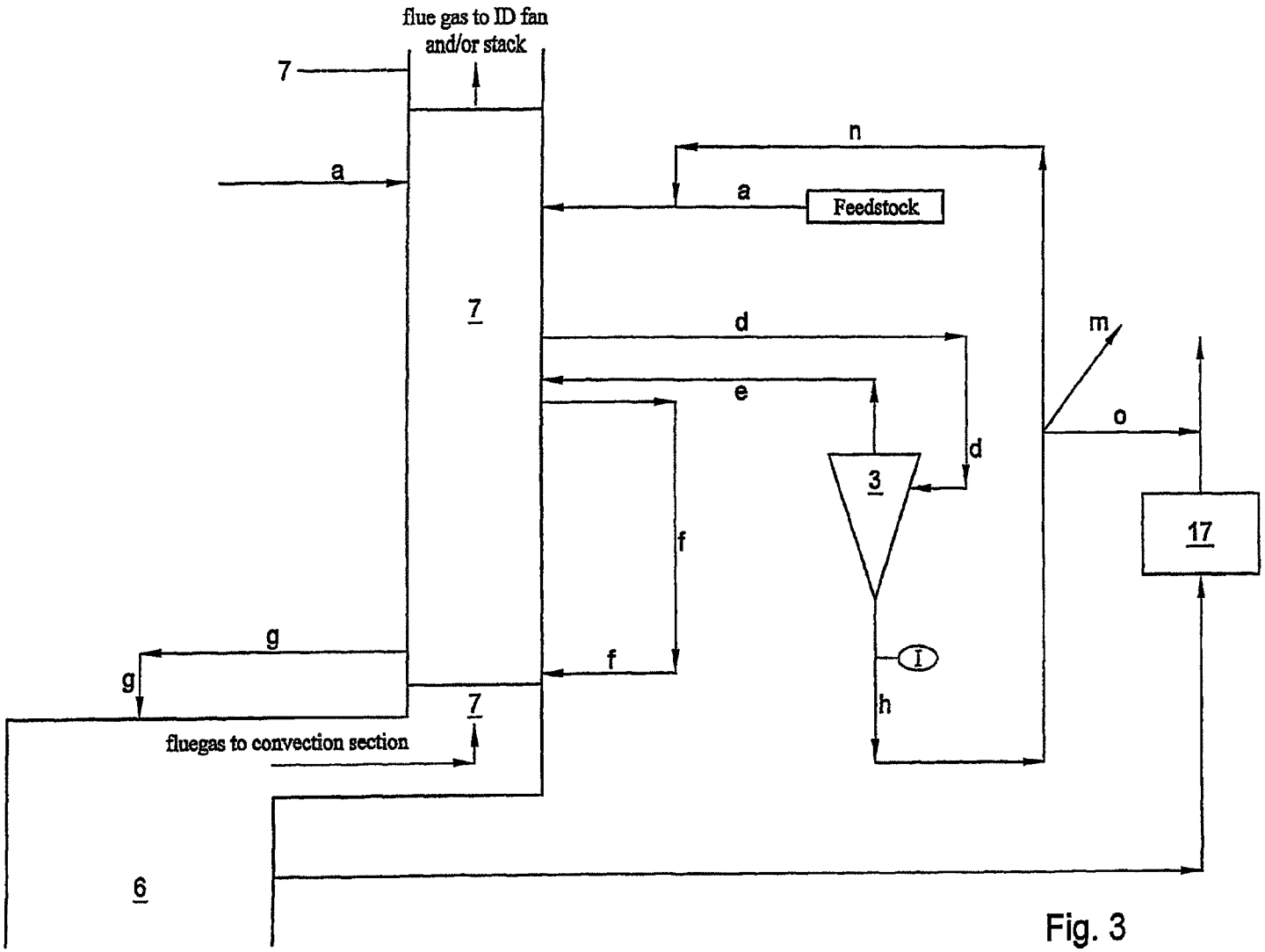
FIG. 3 schematically shows an embodiment wherein at least part of the liquid fraction separated in a separator is further used in the process (recycled to feedstock inlet and/or to the product downstream of the radiant section).

FIG. 3 shows how the liquid effluent from the separator 3 may partially or fully be further used in the process (such as shown in FIG. 1 or 2). The individual elements in the convection section and the controls are not shown. The effluent leaving the separator may be (partially) led back to into the conduit a leading to the feed preheater 1 (not shown) via conduits h and n. The effluent may (partially) be mixed with the cracked product gas, typically downstream of one or more transfer line exchangers 17, of which the feed water conduits are usually in fluid communication with the steam drum (not shown), via conduits h and o. The effluent may (partially) be removed from the process via conduits h and m.

EXAMPLE

Simulated Experiment

A natural gas condensate feedstock is passed through an installation as shown in FIG. 1. The flow of boiler feed water through the lower economiser 9 is varied as a percentage of the total flow of boiler feed water through both economisers. The effect of the flow through the economiser 9 is shown in FIG. 4.

Figure 4:
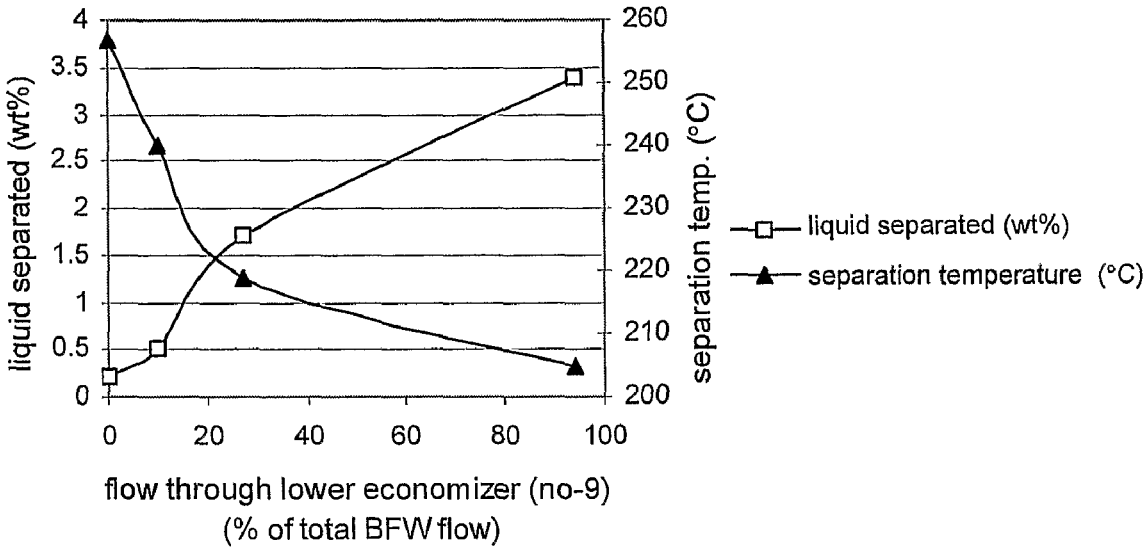
FIG. 4 shows the effect of varying the heat exchange capacity of an economiser in an installation (used in a process) of the invention on the separation temperature and the liquid percentage of the preheated feedstock.

FIG. 4 demonstrates that in this embodiment a separation temperature of approximately 240° C. is achieved by controlling the flow through the lower economiser to a value of approximately 10% of the total flow of boiler feed water, resulting in a liquid separation degree of approximately 0.5 wt %. By increasing the flow rate through the lower economiser to a value of approximately 27% of the total flow of boiler feed water, the heat pick-up of the economiser is increased. As a result the heat pick-up of the feed preheater located above is decreased. As a further consequence, the separation temperature is reduced to approx. 219° C. and the liquid separation degree increased to approximately 1.7%.

This example shows that the heat pick-up of the feed preheater and thereby the separation temperature of the feedstock can be can be controlled by regulating the heat exchange capacity of the economiser 9. Thereby, the liquid percentage can be controlled and adjusted as desired. This allows in particular efficient removal of the heavy tail of a feedstock from the part of the feedstock that is to be cracked.

The invention claimed is:

1. A process for thermally cracking a hydrocarbon feed in an installation comprising a radiant section, a convection section and a feed preheater pick-up controller, the process comprising:

feeding a hydrocarbon feed stock to a feed preheater present in the convection section so as to produce heated feed, wherein the feed preheater as a heat pick-up is imparting heat to the hydrocarbon feed;

separating the heated feed in a separator into a vaporous fraction and a liquid fraction;

controlling the heat pick-up of the feed preheater by regulating a boiler feed water heat exchange medium flow in a heat economizer and a top economiser, wherein the heat economizer is positioned in the convection section between the feed preheater and the radiant section and the top economiser is positioned in the convection section between a flue gas exit of the convection section and the feed preheater; and thereafter cracking at least part of the vaporous fraction in the radiant section, wherein the feed preheater pick-up controller comprises:

an input for registering liquid flow of the liquid fraction leaving the separator and/or an input for registering a temperature of the vaporous fraction leaving the separator, and an output for regulating, based on the input registered, a rate of the flow of the heat exchange medium in the heat economiser and a rate of the flow in the top economiser.

2. The process according to claim 1, wherein the controller output regulates a ratio of the flow of the heat exchange medium flowing through the heat economizer to the flow of the heat exchange medium through the top economiser.

3. The process according to claim 1, further comprising mixing the feed heated in the preheater with a diluent gas prior to the separation.

4. The process according to claim 1, wherein the vaporous fraction is cracked without having been further diluted with dilution gas after the vaporous fraction is separated.

5. The process according to claim 1, wherein the heated feed is separated into the liquid fraction and the vaporous fraction at a temperature in a range of about 190° C. to about 260° C.

6. The process according to claim 1, wherein the feed comprises a heavy tail forming up to about 10 wt. % of the feed.

7. The process according to claim 1, wherein the feed comprises materials such that up to 70 wt % vaporizes at 170° C., up to 80% vaporizes at 200° C., up to 90 wt % vaporizes at 250° C., up to 95 wt % vaporizes at 350° C., and/or up to 99.9 wt % vaporizes at 700° C., as determined by ASTM D-2887.

8. The process according to claim 1, further comprising maintaining a temperature of flue gas at an exit from the convection section at a temperature range of up to about 150° C.

9. The process according to claim 1, further comprising diluting the feed with a diluent gas prior to cracking, wherein the ratio of feed to diluent gas is kept essentially constant.

10. The process according to claim 1, wherein the feed comprises a heavy tail forming up to about 1 wt. % of the feed.

11. The process according to claim 1, wherein the feed comprises a heavy tail forming up to about 0.2 wt. % of the feed.

12. The process according to claim 1, further comprising maintaining a temperature of flue gas at an exit from the convection section in a range of about 90° C. to about 130° C.

13. The process according to claim 1, wherein the heat exchange medium is carried by the top economizer in parallel with the heat economizer.

14. The process according to claim 13, further comprising regulating by the controller the flow of heat exchange medium through the top economizer and the heat economizer.

15. The process of claim 1, wherein the heat exchange capacity of the heat economizer is controlled by the controller comprising a calculator.

16. An installation for cracking a hydrocarbon feed, the installation comprising:

a radiant section configured to crack the feed;

a convection section configured to process the feed and to supply the feed to the radiant section, the convection section comprising:

a feed preheater positioned in the convection section and configured to impart, as a heat pick-up, heat to the feed so as to produce heated feed, the feed preheater comprising an outlet configured to pass out the heated feed from the feed preheater;

a separator configured to separate a vaporous fraction of the heated feed from a liquid fraction of the heated feed, the separator positioned downstream of the feed outlet of the preheater and upstream of the radiator section;

a heat economizer positioned in the convection section between the feed preheater and the radiant section;

a top economizer positioned in the convection section between a flue gas exit of the convection section and the feed preheater, the feed preheater being positioned between the heat economizer and the top economizer; and a controller for controlling the heat pick-up at the feed preheater by regulating a boiler feed water heat exchange medium flowing in the heat economizer, the controller comprising:

a first input configured to register liquid flow of the liquid fraction leaving the separator or a second input configured to register a temperature of the vaporous fraction leaving the separator, and an output configured to regulate a flow of the heat exchange medium to the heat economizer and to the top economiser; and a conduit for feeding the vaporous fraction to the radiant section.

17. The installation for cracking a hydrocarbon feedstock according to claim 16, further comprising;

wherein the controller is configured to regulate a ratio of the flow of the heat exchange medium flowing through the heat economiser to the flow of the heat exchange medium through the top economiser.

18. The installation according to claim 17, wherein the economizer is configured to carry the heat exchange medium in parallel with the top economizer.

19. The installation according to claim 18, the controller is configured to regulate the flow of heat exchange medium through the top economizer and the heat economizer.

20. The installation according to claim 16, further comprising a mixer configured to mix the feed with a dilution gas upstream of the separator.

21. The installation of claim 16, wherein the controller for controlling the heat pick-up comprises a calculator.

* * * * *

UNITED STATES PATENT AND TRADEMARK OFFICE

CERTIFICATE OF CORRECTION

PATENT NO. : 8,398,846 B2
APPLICATION NO. : 11/814447
DATED : March 19, 2013
INVENTOR(S) : Overwater et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 511 days.

Signed and Sealed this
First Day of September, 2015

Michelle K. Lee

Michelle K. Lee
*Director of the United States Patent and Trademark Office*